US008075081B2

(12) United States Patent
Tatsuta

(10) Patent No.: US 8,075,081 B2
(45) Date of Patent: Dec. 13, 2011

(54) ADJUSTING METHOD FOR USE IN RECORDING APPARATUS, RECORDING APPARATUS

(75) Inventor: Seiji Tatsuta, Tokyo (JP)

(73) Assignees: Ortek Corporation, Tokyo (JP); Riso Kagaku Corporation, Tokyo (JP)

( * ) Notice: Subject to any disclaimer, the term of this patent is extended or adjusted under 35 U.S.C. 154(b) by 1049 days.

(21) Appl. No.: 11/912,295

(22) PCT Filed: Apr. 12, 2006

(86) PCT No.: PCT/JP2006/307758

§ 371 (c)(1), (2), (4) Date: Oct. 22, 2007

(87) PCT Pub. No.: WO2006/117987

PCT Pub. Date: Nov. 9, 2006

(65) Prior Publication Data

US 2009/0058906 A1 Mar. 5, 2009

(30) Foreign Application Priority Data

Apr. 26, 2005 (JP) ..... 2005-128015

(51) Int. Cl.
*B41J 29/393* (2006.01)

(52) U.S. Cl. ..... 347/19; 347/15

(58) Field of Classification Search ..... 347/8, 15, 347/19

See application file for complete search history.

(56) References Cited

U.S. PATENT DOCUMENTS

2006/0007257 A1* 1/2006 Chiwata ..... 347/15

FOREIGN PATENT DOCUMENTS

| | | | |
|---|---|---|---|
| JP | 8-258328 A | | 10/1996 |
| JP | 08258328 A | * | 10/1996 |
| JP | 10-157191 A | | 6/1998 |
| JP | 2000-062148 A | | 2/2000 |
| JP | 2002-103680 A | | 4/2002 |
| JP | 2002-144542 A | | 5/2002 |
| JP | 2005-053617 A | | 3/2005 |

* cited by examiner

*Primary Examiner* — Laura Martin

(74) *Attorney, Agent, or Firm* — Holtz, Holtz, Goodman & Chick, PC

(57) ABSTRACT

This invention provides an adjusting method for use in a recording apparatus having a configuration where head units, in each of which a plurality of recording heads are arranged in a direction (main scanning direction) orthogonal to a moving direction (sub-scanning direction) of a recording medium relative to the recording heads so that ends of recordable regions of the recording heads partially overlap or contact when viewed in a conveyance direction of the recording medium, are arranged by a number equal to the number of recording colors in parallel in the sub-scanning direction, comprising adjusting quality of an image recorded on the recording medium by changing a positional relationship of a predetermined recording pattern, which is recorded on the recording medium with each of the recording heads, within each of the head units and/or among the plurality of head units.

11 Claims, 24 Drawing Sheets

ADJUSTING METHOD FOR USE IN RECORDING APPARATUS, RECORDING APPARATUS

This application is a U.S. National Phase Application under 35 USC 371 of International Application PCT/JP2006/307758 filed Apr. 12, 2006.

TECHNICAL FIELD

The present invention relates to an adjusting method for use in a recording apparatus, and a recording apparatus, and more particularly, to an effective technique applied to a recording apparatus the line head of which is implemented with a plurality of short recording heads in a pseudo manner, or the like.

BACKGROUND ART

For various types of printers, such as an inkjet printer, etc., using a recording head (hereinafter referred to simply as a head), there are a so-called multi-pass method for making recording while alternately moving a head and a recording medium in a nearly orthogonal direction by using short heads, and a so-called one-pass method for making recording by relatively moving a recording medium in a direction nearly orthogonal to a line head with the use of the long head (line head) having a length that can cover the entire region of one side of the recording medium. The latter has a structure where one head comprises many recording elements although its operations are simple and recording can be made at high speed. Therefore, this method has a disadvantage that a yield at the time of head manufacturing is low, or a cost becomes high.

Accordingly, a method for configuring a pseudo line head (hereinafter referred to as a "head unit" depending on need) by arranging a plurality of short heads, in which recording elements are arranged in one direction (main scanning direction), by displacing the short heads to prevent their positions from interfering with one another is known as recited in Patent Document 1.

At this time, recording corresponding to image data can be made by switching the input image data in an overlapping region of the recordable regions of a plurality of recording heads, which are alternately arranged (staggered) in parallel to main scanning direction, and by displacing the recording timing of each of the heads by D/V according to a displacement D in a conveyance direction (sub-scanning direction) and a conveyance velocity V.

The above described pseudo line head implemented by combining a plurality of short heads has the advantages of both the multi-pass method and the one-pass method. However, unless the relative positions, the inclinations, and the recording timings of the short heads are suitably adjusted, stripe density unevenness, a white patch, a discontinuous line, or a color shift occurs at a joint of a recording image, leading to possible loss of recording quality.

Accordingly, the technique of Patent Document 1 recites a method for improving stripe density unevenness and a white patch, which occur at a joint of a recording image, by arranging adjacent short heads in predetermined positions, and by selecting a recording element to be used according to the interval (projection interval in sub-scanning direction) of recording elements at a joint.

Additionally, as a method for improving a yield at the time of head manufacturing, which is determined by variations in nozzle positions of a long head, Patent Document 2 recites a method for absorbing variations in nozzle positions at the time of manufacturing in a paper feed direction by delaying ink emission timing independently of each nozzle in a song head.

However, a mechanism for adjusting recording timing for each recording element (nozzle) is complicated, and an increase in cost is unavoidable also in consideration of a head replacement at the time of breakage.

In the meantime, also if a pseudo line head is configured by combining short heads, there is a problem that a discontinuity or a color shift at a joint of a recording image occurs when the distortion or the inclination shift of each short head, variations in arrangement positions of recording elements due to manufacturing unevenness, and the like occur.

For example, if an inclination shift occurs in a short head that configures a head unit as shown in FIG. 1, and if recording timing is made to simply match at the center of a recording pattern, this causes a problem such that a level difference occurs at a joint, and a linear line is recorded discontinuously. This is because the number of recording element sequences actually reaches several hundreds, and a shift is prone to occur at the end of a head even if the head has almost no inclination, although FIG. 1 is schematically depicted. Additionally, for a short head having an inclination shift or distortion, a color shift can sometimes occur in superposed color recording as shown in FIG. 2.

Here, the quality of an image to be recorded is evaluated with linearity in sub-scanning direction (conveyance direction of a recording medium), continuity at a head boundary, a color shift in superposed color recording, and the like. However, quality to be stressed may differ by image to be recorded. For example, if an image composed of a lot of drawn lines is recorded at many times, stress is placed on continuity at a head boundary. Or, for an image the color hue of which is important, stress is placed on a color shift in superposed color recording.

Patent Document 1: Japanese Published Unexamined Patent Application No. 2002-144542

Patent Document 2: Japanese Published Unexamined Patent Application No. 2000-62148

DISCLOSURE OF INVENTION

An object of the present invention is to provide a technique for adequately suppressing degradations in quality, such as discontinuity, a color shift, etc. according to desired recording quality without being influenced by the distortion or the inclination shift of each of short heads, variations in the positions of recording elements (hereinafter referred to generically as "variations" depending on need) due to manufacturing unevenness in a recording apparatus the pseudo line head of which is configured by combining the short heads.

Another object of the present invention is to provide a technique with which image recording with diverse recording qualities can be implemented on a recording medium without being influenced by the distortion or the inclination shift of each of short heads, variations in the positions of recording elements due to manufacturing unevenness in a recording apparatus the pseudo line head of which is configured by combining the short heads.

A first aspect of the present invention is an adjusting method for use in a recording apparatus having a configuration where head units, in each of which a plurality of recording heads are arranged in a main scanning direction crossing the moving direction (sub-scanning direction) of a recording medium relative to the recording heads so that the ends of recordable regions of the recording heads partially overlap or contact when viewed in a conveyance direction, are arranged by a number equal to the number of recording colors in parallel in the sub-scanning direction, comprising adjusting the quality of an image recorded on the recording medium by changing a positional relationship of a predetermined recording pattern, which is recorded on the recording medium with each of the recording heads, within each of the head units and/or among the plurality of head units.

A second aspect of the present invention is an adjusting method for use in a recording apparatus where head units, in each of which a plurality of recording heads having a recording element sequence recording a predetermined recording pattern on a recording medium are arranged nearly orthogonal to the relative moving direction of the recording medium so that the recordable regions of adjacent recording heads partially overlap or contact, are arranged by a plural number equal to the number of colors in the moving direction to make the recordable regions overlap, for making desired image recording in a way such that the recording heads within each of the head units collaborate with one another by adjusting the position, the inclination, the recording timing, etc. of each of the recording heads, comprising adjusting the position, the inclination, the recording timing, etc. of each of the recording heads to satisfy at least one or a combination of conditions such as a first adjustment condition for adjusting the center of a recording pattern recorded by each of the recording heads of the same color to be placed almost in the same linear line, a second adjustment condition for adjusting the boundaries of recording patterns recorded by adjacent recording heads of the same color to be almost continuous, a third adjustment condition for adjusting the centers of recording patterns recorded by recording heads of respective colors, which have the same recording region, to almost match, and a fourth adjustment condition for adjusting the centers of the recording patterns, which are recorded by all the recording heads of the respective colors, for the respective head units to almost match, when the recording pattern is recorded on the recording medium with a superposed color.

A third aspect of the present invention is a recording apparatus, which has a conveyance mechanism for moving a recording medium in a first direction with reference to recording heads (relative to the recording medium), a plurality of head units arranged in parallel in the first direction (sub-scanning direction), and a plurality of recording heads, which are arranged in each of the plurality of head units and arranged in a second direction (main scanning direction) crossing the first direction so that their recordable regions partially overlap or become continuous, for making desired image recording on the recording medium by combining a nearly line recording operation, which is performed by the plurality of recording heads in the second direction, and the moving operation of the recording medium, which is performed by the conveyance mechanism in the first direction, comprising first controlling means for controlling at least one of the positions, the inclinations, and the recording timings of the plurality of recording heads in each of the plurality of head units, and second controlling means for controlling at least one of the positions, the inclinations, and the recording timings of the recording heads among the plurality of head units, wherein said first controlling means has a control function to implement at least one of a first adjustment condition under which the center of a predetermined recording pattern recorded by each of the plurality of recording heads within the head unit is placed almost in the same linear line in the second direction, and a second adjustment condition under which the boundaries of recording patterns recorded by the plurality of recording heads within the head unit become almost continuous, and said second controlling means has a control function to implement at least one of a third adjustment condition under which the centers of recording patterns recorded by the plurality of recording heads within the respective head units, which have the same recordable region, almost match in the second direction, and a fourth adjustment condition under which the centers of the plurality of recording patterns, which are recorded by all the recording heads of the plurality of head units, for the respective head units, in the first direction almost match in the first direction.

BEST MODE OF CARRYING OUT THE INVENTION

Preferred embodiments according to the present invention are described in detail below with reference to the drawings.

Figure 3:
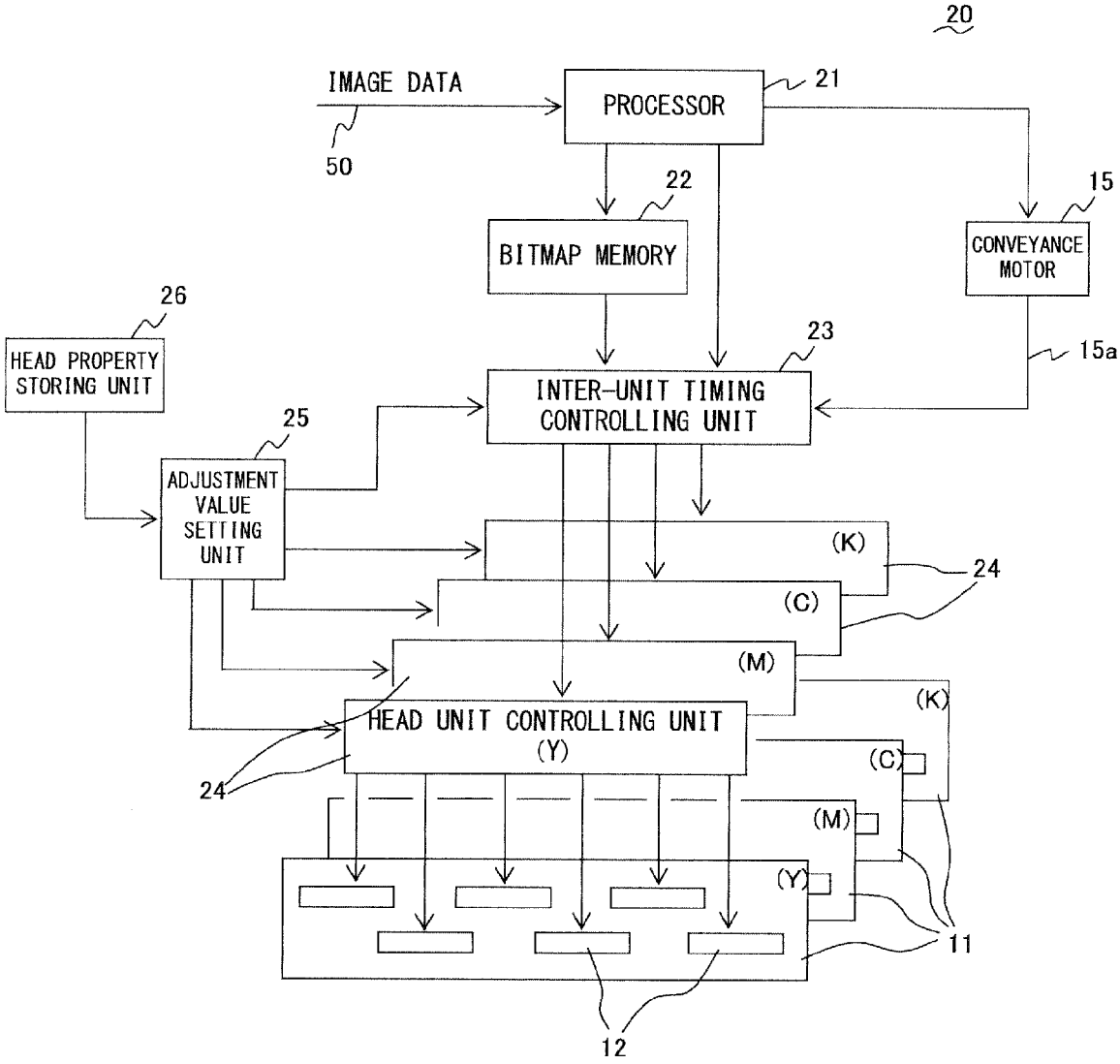
FIG. 3 is a block diagram showing one example of a recording controlling system of a recording apparatus for implementing an adjusting method for use in the recording apparatus, which is one preferred embodiment of the present invention.
Figure 4:
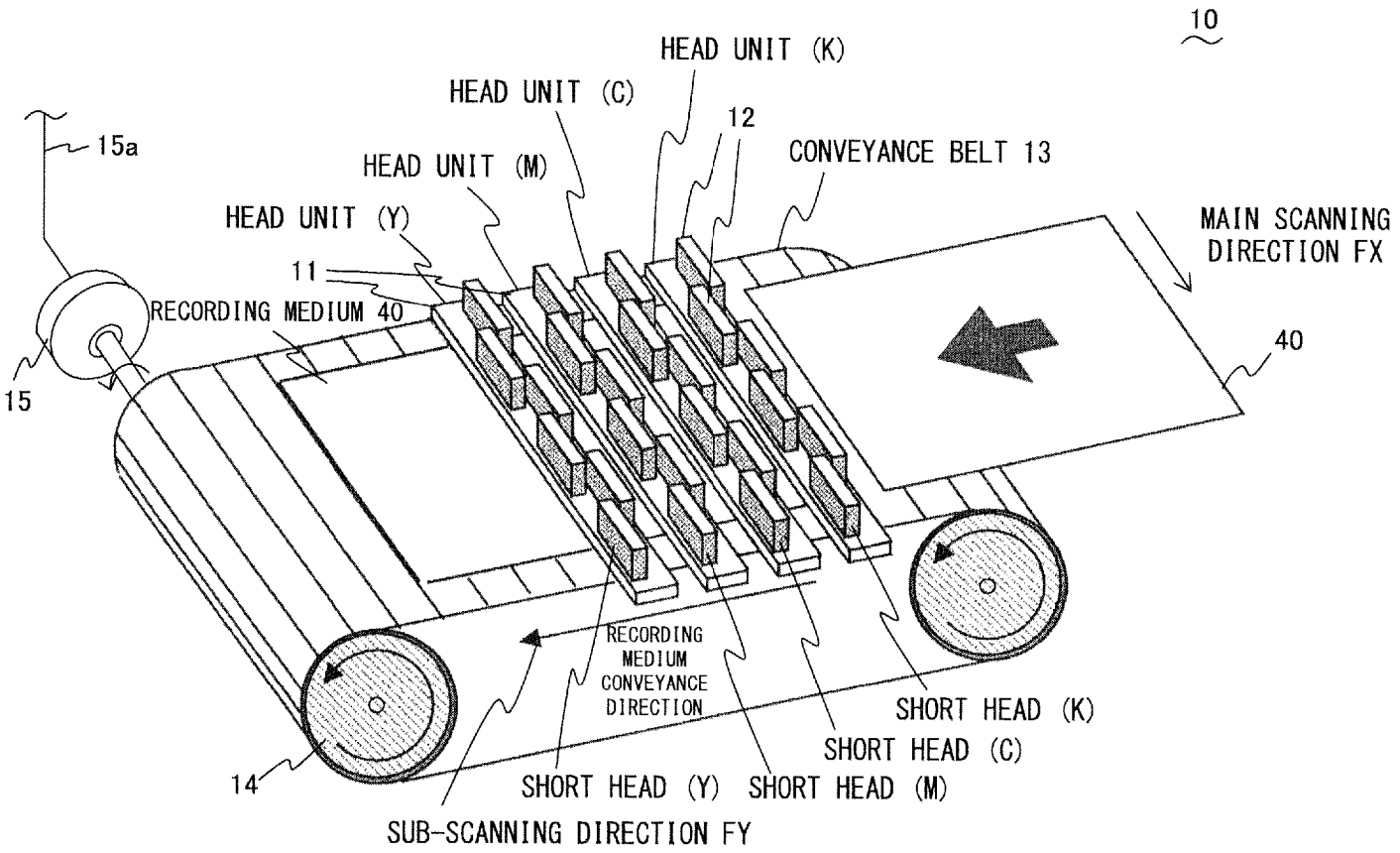
FIG. 4 is a perspective view showing one example of a configuration of a recording mechanism unit of the recording apparatus, which is one preferred embodiment of the present invention.
Figure 5:
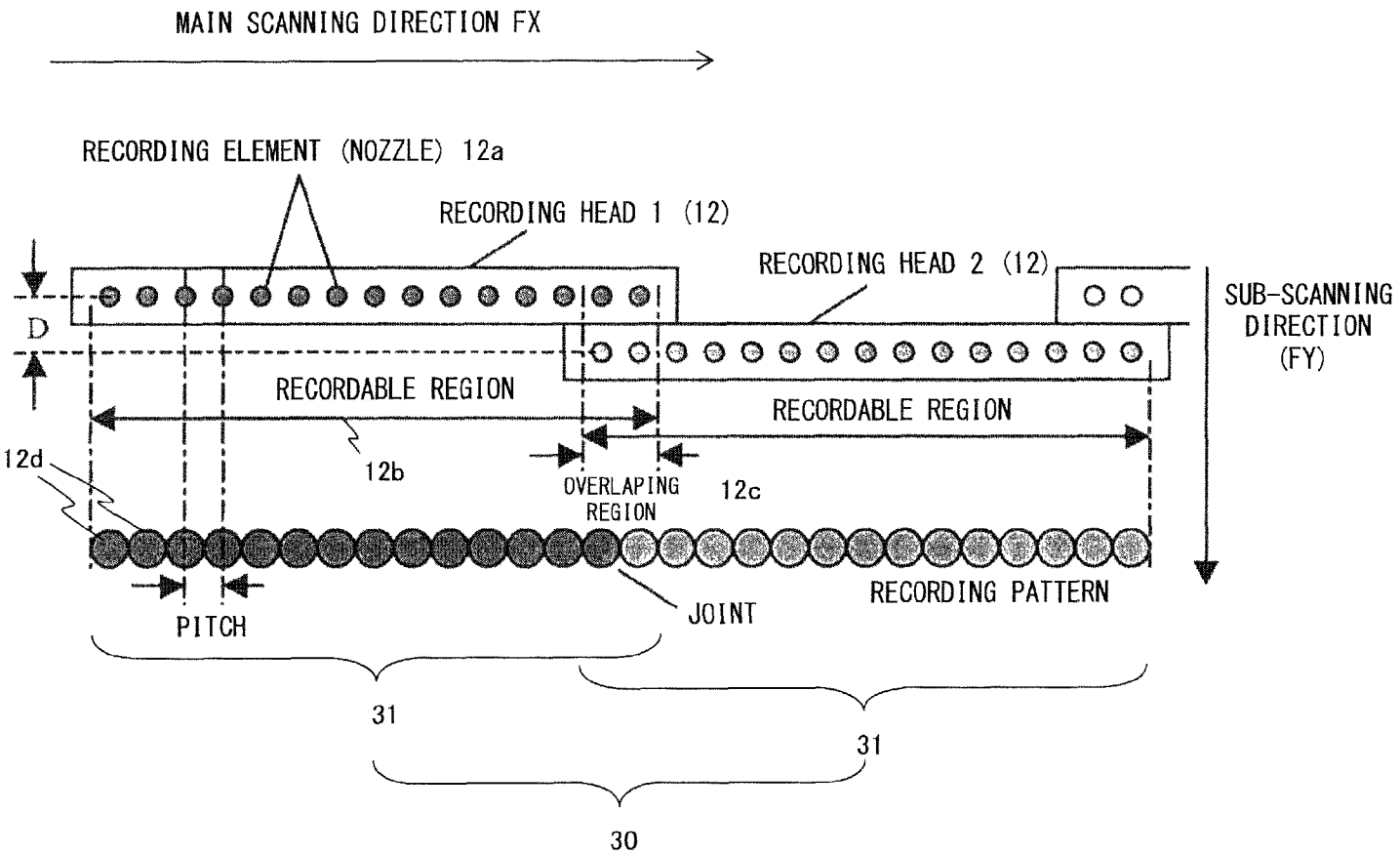
FIG. 5 is an enlarged conceptual schematic showing part of the recording mechanism unit of the recording apparatus, which is one preferred embodiment of the present invention.
Figure 6:
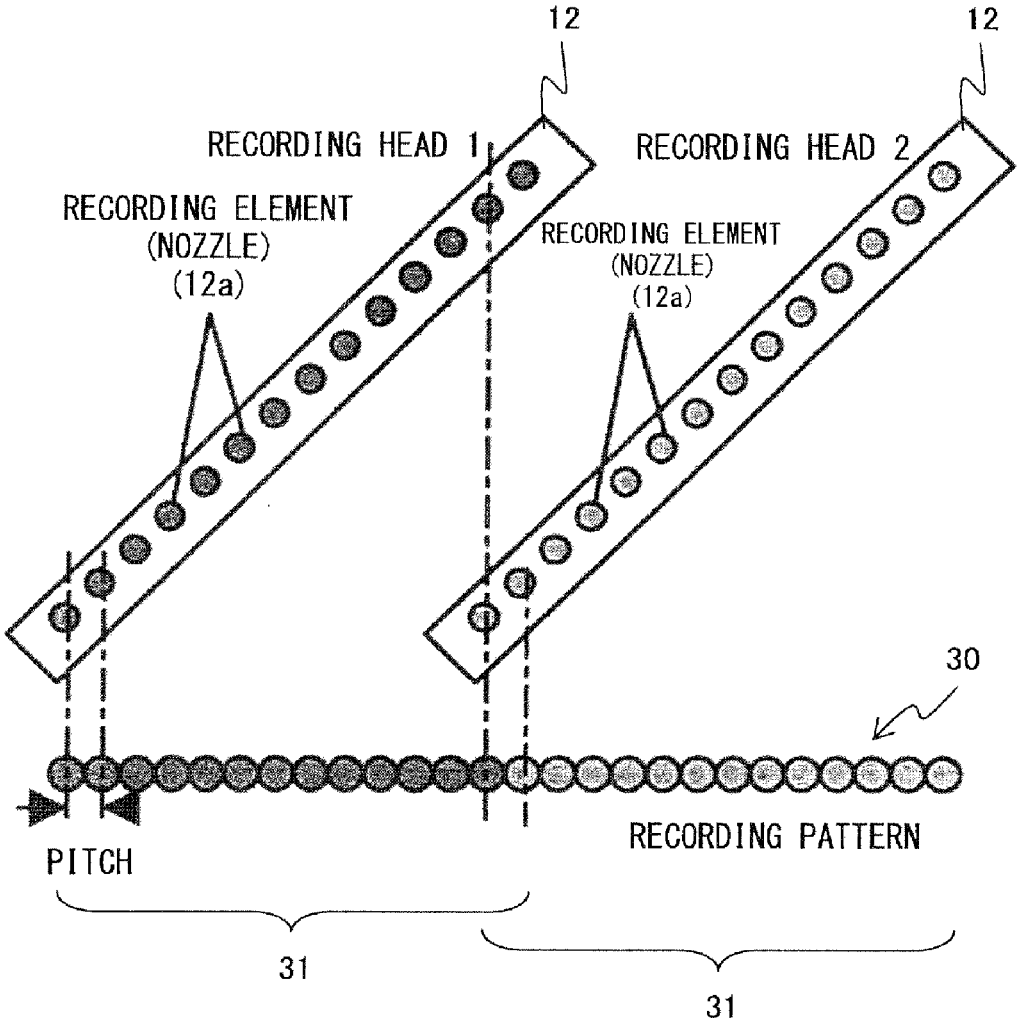
FIG. 6 is a conceptual schematic showing a modification example of the recording mechanism unit of the recording apparatus, which is one preferred embodiment of the present invention.
Figure 7:
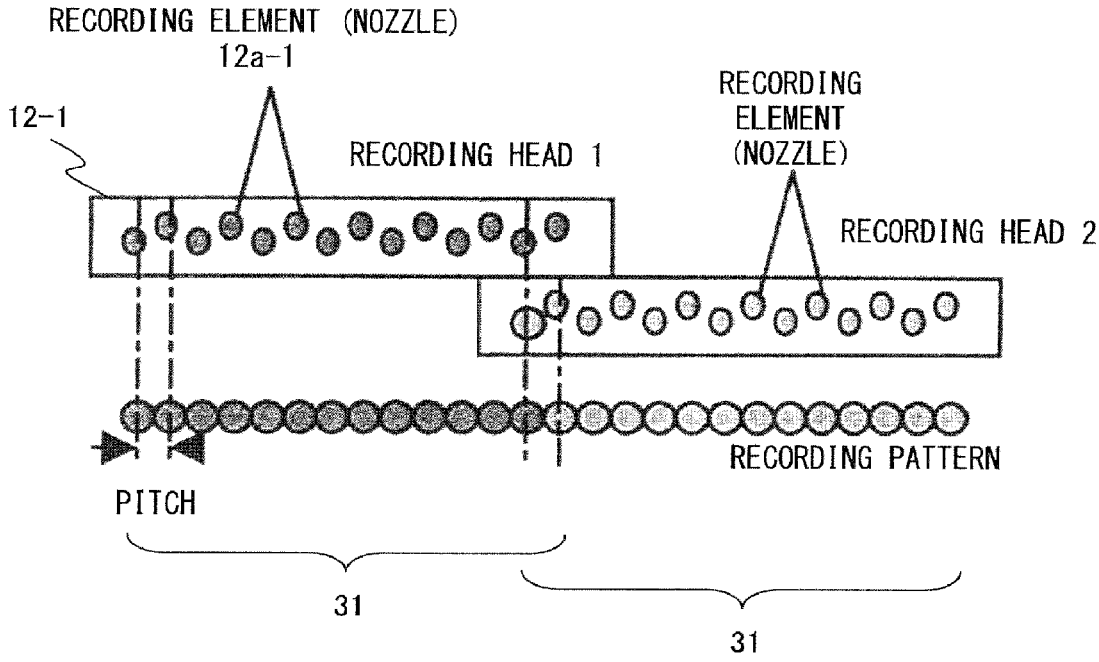
FIG. 7 is a conceptual schematic showing a modification example of the recording mechanism unit of the recording apparatus, which is one preferred embodiment of the present invention.

FIG. 3 is a block diagram showing one example of a recording controlling system of a recording apparatus implementing an adjusting method for use in the recording apparatus, which is one preferred embodiment of the present invention, FIG. 4 is a perspective view showing one example of a configuration of a recording mechanism unit of the recording apparatus according to this preferred embodiment, and FIG. 5 is an enlarged conceptual schematic showing part of the recording mechanism unit. FIGS. 6 and 7 are conceptual views showing modification examples of the recording mechanism unit.

The recording apparatus according to this preferred embodiment includes a recording controlling system 20 exemplified in FIG. 3, and a recording mechanism unit 10 which operates under the control of the recording controlling system 20.

As exemplified in FIG. 4, the recording mechanism unit 10 according to this preferred embodiment comprises a conveyance belt 13, which is stretched on belt driving drums 14, for conveying a recording medium 40 in a sub-scanning direction FY, and a conveyance motor 15 for driving the conveyance belt 13 via the belt driving drums 14.

On the conveyance path of the recording medium 40, which is implemented by the conveyance belt 13, a plurality of head units 11 are arranged to cross the recording medium 40 in parallel to the width direction (a main scanning direction F'X) of the recording medium 40.

The plurality of head units 11 are composed of a head unit Y corresponding to the recording color of yellow (Y), a head unit M corresponding to the recording color of magenta (M), a head unit C corresponding to the recording color of cyan (C), and a head unit K corresponding to the recording color of black (K). These units are arranged in parallel at a predetermined pitch from the downstream side to the upstream side of the sub-scanning direction FY.

These head units 11 of the respective colors are arranged in parallel to the conveyance direction (sub-scanning direction FY) of the recording medium 40 so that their recording regions overlap, and can make color recording on the recording medium 40, which is conveyed by the belt, with one pass.

In the following description, the head units 11 are referred to generically as head units 11, or referred to as head units Y to K if they are cited by color.

Each of the head units 11 is provided with a plurality of short heads 12 for performing a recording operation of the same color set in the corresponding head unit 11. As exemplified in FIGS. 4 and 5, the plurality of short heads 12 are arranged by being staggered along the main scanning direction FX within each of the head units 11.

Each of the short heads 12 is provided with a plurality of recording elements 12*a* in its longitudinal direction. Each of the recording elements 12*a* is implemented, for example, with a nozzle emitting an ink, etc. of a predetermined recording color.

Each of the short heads 12 is arranged so that its end overlaps with an adjacent short head 12 when viewed in the sub-scanning direction FY. As exemplified in FIG. 5, the ends of arrangement regions (recordable regions 12*b*) of the recording elements 12*a* overlap each other and configure an overlapping region 12*c* when viewed in the sub-scanning direction FY. Input data is recorded by switching a short head 12, which is responsible for recording in a predetermined position within the overlapping region 12*c*, and by using the position as a joint. In this case, the pitch of pixels, which configure a recording pattern 30 recorded on the recording medium 40, matches the arrangement pitch of recording elements 12*a* in the short head 12.

Here, recording corresponding to image data can be made by shifting the recording timing of each adjacent short head 12 by D/V according to a shift D in the conveyance direction (sub-scanning direction) and a conveyance velocity V even if the short head 12 is switched at a joint.

In this way, for example, if linear image data, which extends in the main scanning direction FX, is input to the recording controlling system 20, a linear recording pattern 31, which extends in the main scanning direction FX, is transferred onto the recording medium 40 by the recording elements 12*a* of each short head 12, and the plurality of short heads 12 within the head unit 11 collaborate with one another as described above, whereby linear recording patterns 31 can be placed in series in the main scanning direction FX, and the linear recording pattern 30, which crosses the recording medium 40 in the width direction, is configured.

Here, for ease of explanation, the description is provided by taking the example where the linear image data in the main scanning direction FX is input. Naturally, a recording pattern corresponding to image data is drawn by inputting the predetermined image data. Hereafter, a pattern recorded by each short head 12 when such linear image data is input is referred to as a "unit pattern 31" depending on need to simplify the explanation. However, the unit pattern 31 is not limited to the linear line, and a pattern in a predetermined format can be also used as a replacement.

The method for arranging the short heads 12 is not limited to the arrangement method for alternately staggering the short heads 12 in parallel in the main scanning direction as in the above described FIG. 5. The arrangement method may be a method for arranging short heads 12, in which the arrangement pitch of recording elements 12*a* is wider than that of target pixels, by inclining them at a predetermined angle with reference to the main scanning direction FX as shown in FIG. 6, and for obtaining the pitch of target pixels when viewed in the sub-scanning direction FY.

In this case, each of the recording elements 12*a* is configured to have a predetermined delay recording property according to an inclination arrangement position with reference to the main scanning direction FX, whereby unit patterns 31 the recording positions of which are aligned in the main scanning direction FX can be obtained only by providing recording timing in units of short heads 12.

Additionally, also short heads 12-1 exemplified in FIG. 7 can be used. In this case, a plurality of recording elements 12*a-l* are arranged by being staggered with reference to the main scanning direction FX within each of the short heads 12-1, and each of the recording elements 12*a*-1 is endowed with a delay recording property according to an arrangement position in the sub-scanning direction FY, whereby a unit pattern 31 where recording positions are aligned in the main scanning direction FX can be obtained with each of the short heads 12.

Since a relationship between image data input to each short head and a recording pattern is the same, the following description is further provided by assuming the configuration of the short heads 12 exemplified in FIG. 5.

The recording apparatus according to this preferred embodiment further comprises a paper feeding unit for feeding the recording medium 40 to the recording mechanism unit 10, a paper ejecting unit for ejecting the recorded recording medium 40, an ink supplying unit, etc., which are not shown, in addition to the recording mechanism unit 10 for making recording on the recording medium 40.

The recording controlling system 20 for controlling the recording mechanism unit 10 in this preferred embodiment is described next with reference to FIG. 3.

The recording controlling system 20 according to this preferred embodiment comprises a processor 21, a bitmap memory 22, an inter-unit timing controlling unit 23, a head unit controlling unit 24, an adjustment value setting unit 25, and a head property storing unit 26.

The processor 21 has a function to control the whole of the recording mechanism unit 10 composed of the conveyance motor 15, etc., and the recording controlling system 20, and a function to store image data 50 after processing the image data 50 in a desired format, which arrives from an external higher-order system, and expanding the image data 50 into a bitmap of each of the colors C, M, Y, and K.

The inter-unit timing controlling unit 23 has a function to read the bit data of one line in the main scanning direction FX, which corresponds to each of the colors, from the bitmap memory 22, and to output the read data to the head unit controlling unit 24 corresponding to each of the colors in synchronization with a conveyance timing signal 15*a* obtained from the conveyance motor 15, and a function to make color printing, which is implemented by superposing a plurality of recording colors, with one pass by controlling the recording timings of the plurality of head units 11 in the sub-scanning direction FY.

In the case of this preferred embodiment, the inter-unit timing controlling unit 23 performs operations for implementing third and fourth adjustment conditions to be described later by adjusting recording timings among the plurality of head units 11.

The head unit controlling unit 24 is provided for each of the plurality of head units 11 (the head unit Y to the head unit K). The head unit controlling unit 24 has a function to distribute the bit data of one line, which is input from the inter-unit timing controlling unit 23, to the plurality of short heads 12 belonging to a subordinate head unit 11, and to control the recording timings of the recording elements 12*a* in the short heads 12 in units of short heads 12.

The above provided description refers to the example where the inter-unit timing controlling unit 23 and the head unit controlling unit 24 are separately provided for convenience of explanation. However, these units may be integrated into one body. Or, the functions of the inter-unit timing controlling unit 23 and the head unit controlling unit 24 may be implemented with software executed by the processor 21.

Figure 1:
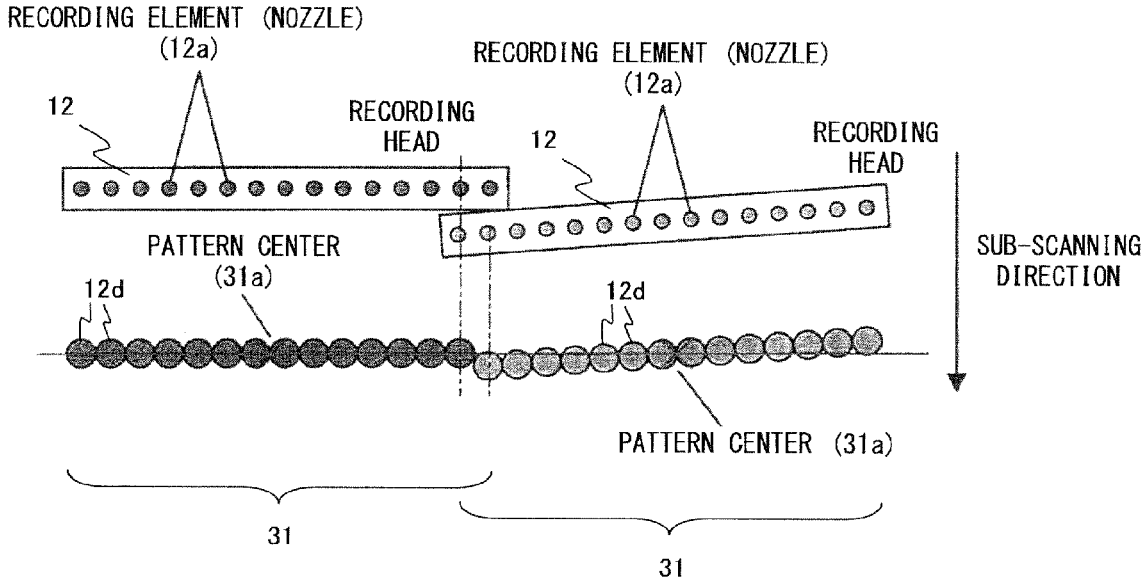
FIG. 1 is a conceptual schematic showing a problem of a recording pattern at a joint, which is caused by a positional shift of a short head configuring a line head in a pseudo manner.
Figure 2:
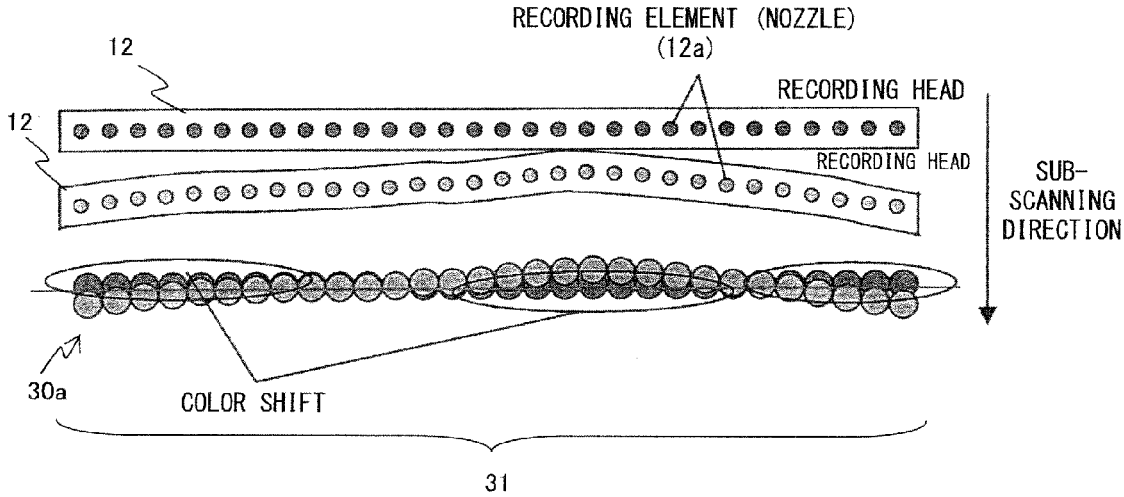
FIG. 2 is a conceptual schematic showing the occurrence of a color shift, which is caused by the undulations, etc. of the arrangement state of recording elements in a short head.

Here, it is general that pixels recorded by the plurality of recording elements 12*a* in each of the short heads 12 have variations in ideal recording positions due to a slight inclination of the entire short head 12, which is exemplified in FIG. 1, with reference to the main scanning direction FX, or the undulations, etc. of the arrangement state of the recording elements 12*a*, which are exemplified in FIG. 2. Such variations in recording positions are visually identified as a level difference in single-color recording, or as a color shift in superposed color recording.

In this preferred embodiment, information about such variations in the recording positions of the recording elements 12*a* in each of the short heads 12 is measured beforehand by making test printing, etc., and correction information for controlling each of the short heads 12 is stored in the head property storing unit 26 in order to suitably correct the variations at the time of recording. Namely, in this preferred embodiment, a barycentric position, which is obtained by assigning an equal weight to all of positions of the plurality of pixels 12*d* that configure the unit pattern 31 recorded by the plurality of recording elements 12*a* in each of the short heads 12, is defined as a pattern center 31*a*, and correction information such as a shift amount of the pattern center 31*a* with reference to the barycenter of a plurality of unit patterns (hereinafter referred to as a "unit center 11*a*" depending on need) recorded by the entire head unit 11 is measured at the timing of a manufacturing phase or a maintenance check, etc., and stored in the head property storing unit 26.

Furthermore, also information about variations, etc. in the intervals of unit centers 11*a* in the arrangement direction (sub-scanning direction) of the plurality of head units 11 is measured beforehand, and stored in the head property storing unit 26.

The correction information stored in the head property storing unit 26 is input to the inter-unit timing controlling unit 23 and the head unit controlling unit 24 via the adjustment value setting unit 25.

If the manufacturing precision of the short heads 12 or the precision of installation on the head unit 11 is sufficiently high, almost no variations of the recording elements 12*a* exist, also the precision of installation of the head units 11 in the recording apparatus is sufficiently high, and almost no variations in the intervals of unit centers 11*a* exist, the inter-unit timing controlling unit 23 sets the recording timing of each of the head unit controlling units 24 to timing, which is calculated from the installation position of the head unit 11 in design, so that the unit centers 11*a* of the head units 11 of the respective colors overlap, at the time of superposed color pattern recording.

Additionally, each of the head unit controlling units 24 controls the recording timings of the plurality of short heads 12 in its subordinate head unit 11 in units of short heads 12.

At this time, each of the head unit controlling units 24 sets, with reference to the unit center 11*a*, timings, at which the plurality of short heads 12 belonging to the corresponding head unit 11 make recording on the recording medium 40, to timings calculated from the installation positions of the respective short heads 12 in design based on timing specified by the higher-order inter-unit timing controlling unit 23 so that the pattern centers 31*a* of patterns recorded by the short heads 12 are placed in a linear line in the main scanning direction FX.

Figure 8:
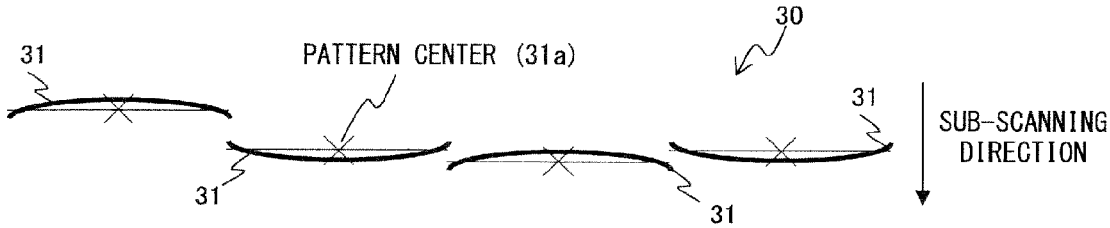
FIG. 8 is a schematic explaining one example of an operation when an adjustment is not made in the recording apparatus, which is one preferred embodiment of the present invention.

Generally, however, the manufacturing precision of each of the short heads 12, and the precision of installation on the head unit cannot be sufficiently ensured due to a tradeoff with cost, and with the above described settings, the unit patterns 31 implemented by the short heads 12 become, for example, as in FIG. 8, a state where pixels 12*d* configuring the unit patterns 31 and the pattern centers 31*a* have variations in the sub-scanning direction FY because of the reflection of variations in the arrangement positions of the short heads 12 and the recording elements 12*a* with reference to the head unit 11.

In this preferred embodiment, the above described inter-unit timing controlling unit 23 and head unit controlling unit 24 adaptively control recording timings among the head units 11, and among the plurality of short heads 12 within each of the head units 11 in consideration of variations of the pixels 12*d* which configure each unit pattern 31, whereby the positional relationship of the recording pattern 30 and the unit patterns 31 for the recording medium 40 is suitably adjusted, and a recording image is adjusted to a desired state (quality) as described below.

Here, the adjustment of each short head 12 within each head unit 11 is descried first.

For example, assume that unit patterns 31, which are recorded when an adjustment is not made, namely, when recording timings are controlled based on installation positions in design in a head unit 11 configured with 4 short heads 12, are those shown in FIG. 8. Originally, the unit patterns 31 must be recorded as a linear line in the main scanning direction FX likewise an input image. However, the unit patterns 31 can sometimes become such recording patterns due to the initial position shift or the distortion of each short head 12, which is caused by a lack in installation precision, the manufacturing unevenness of recording elements 12*a*, or the like.

Also in such a case, the head unit controlling unit 24 makes an adjustment (Type-a: (first adjustment condition)) such that the pattern centers 31*a* of the unit patterns 31 recorded by the short heads 12 are placed in the same linear line (namely, the unit center 11*a* of the head unit 11 in this case) in the main scanning direction FX as shown in FIG. 9, whereby variations of an image, which is recorded on the recording medium 40 with the head unit 11, in the sub-scanning direction FY can be suppressed.

Figure 9:
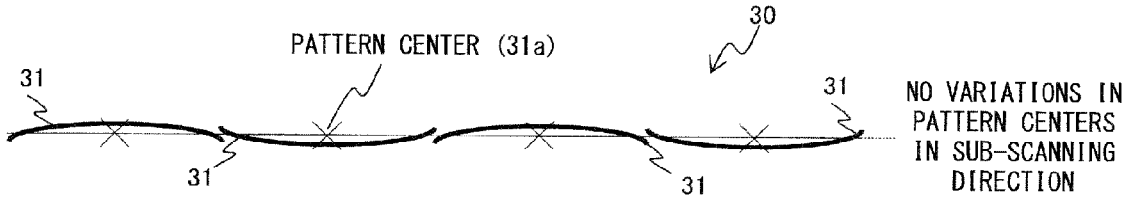
FIG. 9 is a schematic explaining one example of an operation of a first adjustment condition in the recording apparatus, which is one preferred embodiment of the present invention.

Namely, the head unit controlling unit 24 controls the recording timing of each short head 12 to cancel the shift amount of the pattern center 31*a*, which is stored in the head property storing unit 26, whereby the adjustment of Type-a for aligning the pattern centers 31*a* of the plurality of short heads 12 in the main scanning direction FX (unit center 11*a*) can be implemented as shown in FIG. 9.

Figure 10:
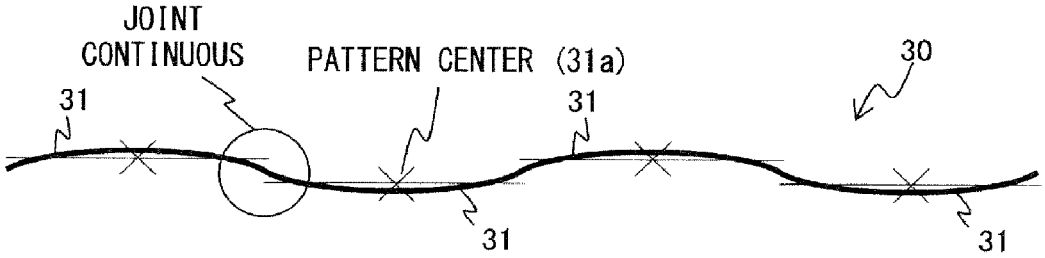
FIG. 10 is a schematic explaining one example of an operation of a second adjustment condition in the recording apparatus, which is one preferred embodiment of the present invention.

Additionally, an adjustment (Type-b: second adjustment condition)) is made to make the boundary (overlapping region 12*c*) of unit patterns 31, which are recorded by adjacent short heads 12, continuous as shown in FIG. 10, whereby discontinuity (level difference) at the head boundary (joint) of the recording pattern 30 where a plurality of unit patterns 31 are arranged in series can be suppressed.

In this case, the head unit controlling unit 24 controls the position of the pattern center 31*a* (namely, the recording timing of the unit pattern 31) of each unit pattern 31 to make the joints of all of unit patterns 31 continuous based on the positional information (which is stored in the head property storing unit 26) of pixels 12*d* in joint positions with reference to the pattern centers 31*a* of the unit patterns 31, whereby the above described adjustment of Type-b exemplified in FIG. 10 can be implemented.

The adjustment of short heads 12 among the plurality of head units 11 in superposed color recording is described next. Here, for ease of explanation, the description is provided by using only K (black), C (cyan), and their respective three short heads 12.

Figure 11:
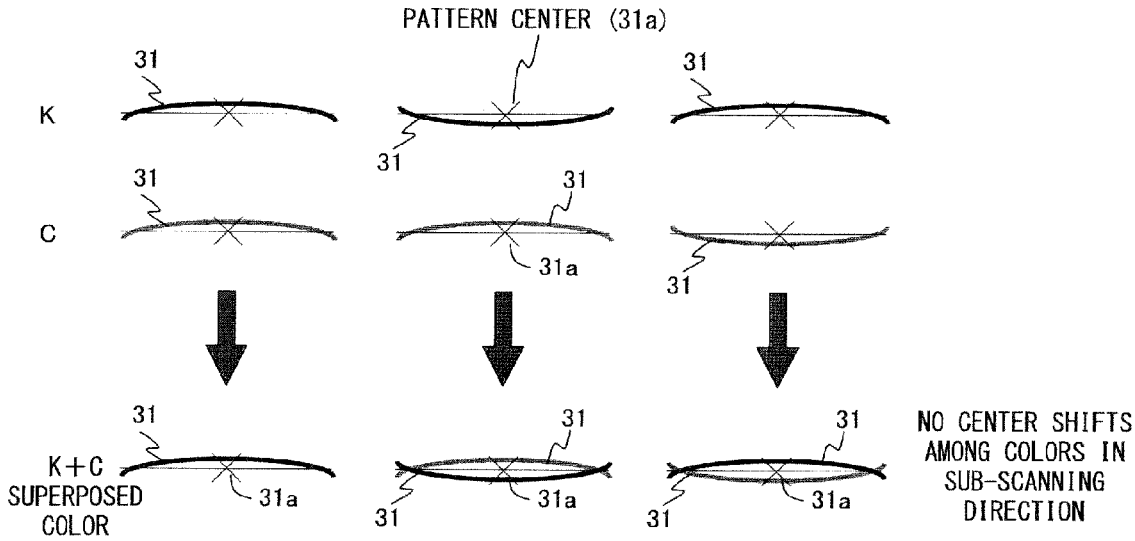
FIG. 11 is a schematic explaining one example of an operation of a third adjustment condition in the recording apparatus, which is one preferred embodiment of the present invention.

For example, if the unit patterns 31 implemented by the short heads 12 are those shown in FIG. 11, an adjustment (Type-c: (third adjustment condition)) is made to make the pattern centers 31*a* of the unit patterns 31, which have the same recording region (namely, which overlap when viewed in the sub-scanning direction FY) as shown at the bottom of FIG. 11 and are recorded by the short heads 12 of the respective colors, match at the time of superposed color recording, whereby a color shift in a superposed color pattern recorded by the respective heads can be suppressed.

In this case, the inter-unit timing controlling unit 23 and the head unit controlling unit 24 read a shift of the pattern center 31*a* from the head property storing unit 26, with reference to the unit center 11*a*, in the group of short heads 12, which correspond to the same recording region among the respective head units 11, use as a reference the pattern center 31*a* of the short head 12 in each recording region in the head unit 11 of one color (such as K), and feed a recording timing control signal to the short head 12 in each recording region to make the recording timing of the pattern center 31*a* of the short head 12 in each recording region of the other head unit C within the group match in order to overlap with the reference. In this way, the above described adjustment of Type-c exemplified in FIG. 11 can be implemented.

Figure 12:
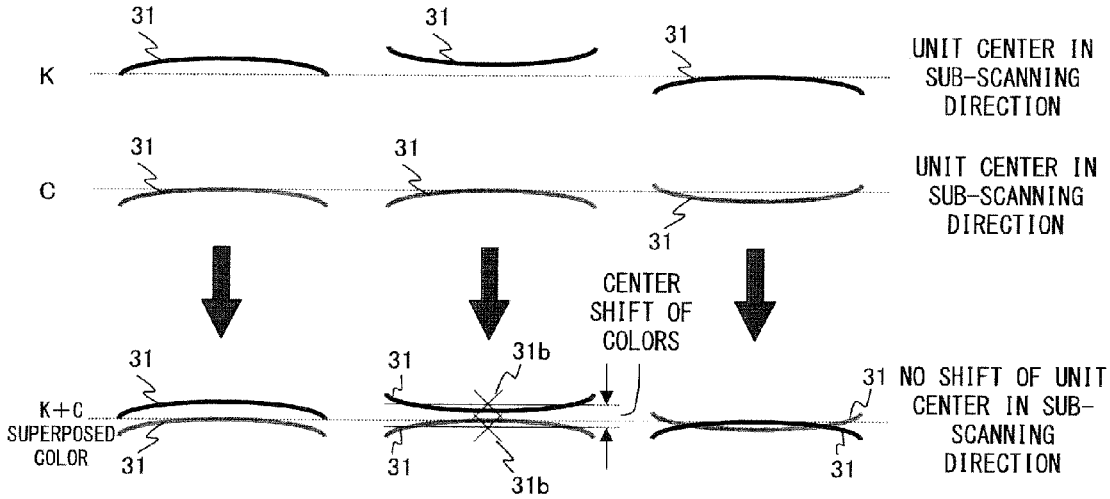
FIG. 12 is a schematic explaining one example of an operation of a fourth adjustment condition in the recording apparatus, which is one preferred embodiment of the present invention.

Furthermore, an adjustment (Type-d: (fourth adjustment condition)) is made to make the unit pattern centers 31*b*, for respective units, of the plurality of unit patterns 31, which are recorded by all of short heads 12, namely, the head units 11 of the respective colors, match as shown in FIG. 12, whereby a color shift of a superposed color pattern 30*a* in the sub-scanning direction FY can be suppressed in units of head units 11.

Namely, this unit pattern center 31*b* can be defined as a barycentric position on a recording plane when an equal weight is assigned to the pattern centers 31*a* of the unit patterns 31 of a plurality of short heads 12 within one head unit 11.

This unit pattern center 31*b* is calculated beforehand and stored in the head property storing unit 26, and can be read and used by the inter-unit timing controlling unit 23 and the head unit controlling unit 24 depending on need.

Namely, the inter-unit timing controlling unit 23 provides recording timing, which is synchronous with the conveyance velocity of the recording medium 40, to the head unit controlling unit 24 of each color to make superposed colors match, and each head unit controlling unit 24 provides recording timing to each short head 12 to make the unit pattern centers 31*b* match at the above recording timing. In this way, the above described adjustment of Type-c shown in FIG. 12 can be implemented.

As described above, with the recording apparatus exemplified in FIGS. 3 and 4, the recording timings, etc. of the head units 11 and the short heads 12 can be suitably adjusted according to quality (recording property) to be stressed depending on the recording image of the image data 50, whereby a recording image of desired quality can be obtained.

Examples where the recording apparatus is adjusted by respectively combining these four conditions of Type-a to Type-d (adjustment conditions) are described below.

First Preferred Embodiment

Figure 13:
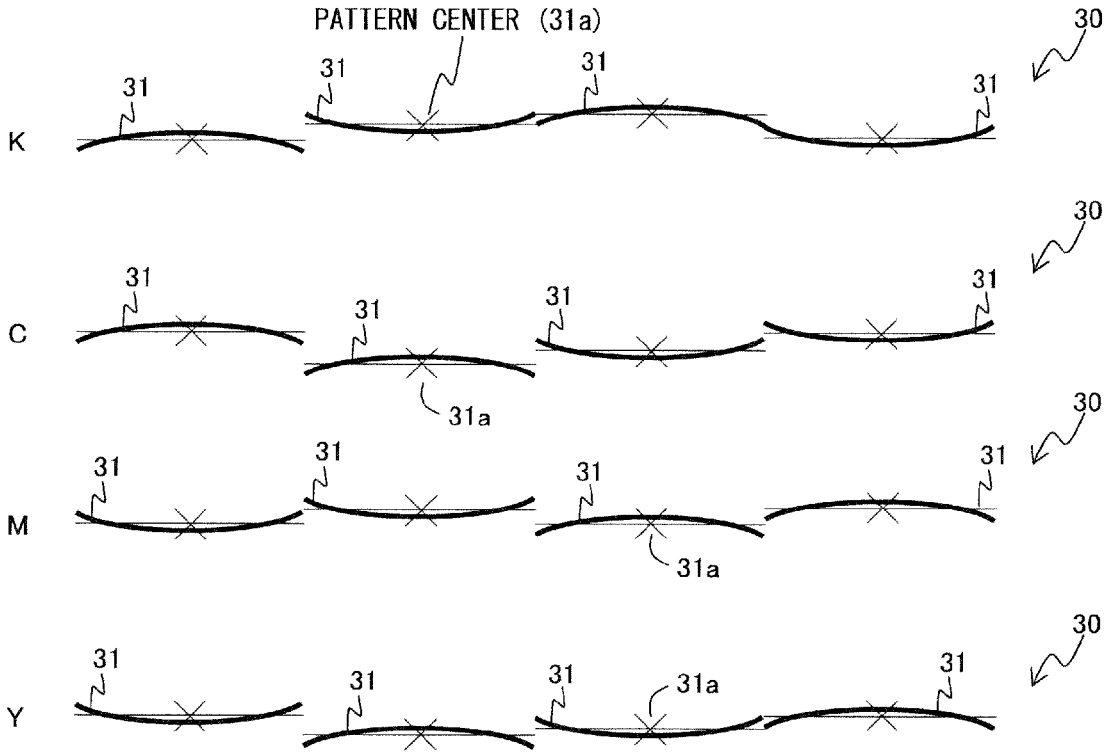
FIG. 13 is a schematic explaining one example of an operation when an adjustment is not made in color recording in the recording apparatus, which is one preferred embodiment of the present invention.

The first preferred embodiment is described by taking as an example a case where recording patterns 30 by respective head units 11 when an adjustment is not made at the time of inputting a linear line image parallel to the main scanning direction as image data 50 are those shown in FIG. 13 in the recording apparatus having the recording mechanism unit 10 shown in FIG. 4.

Figure 14:
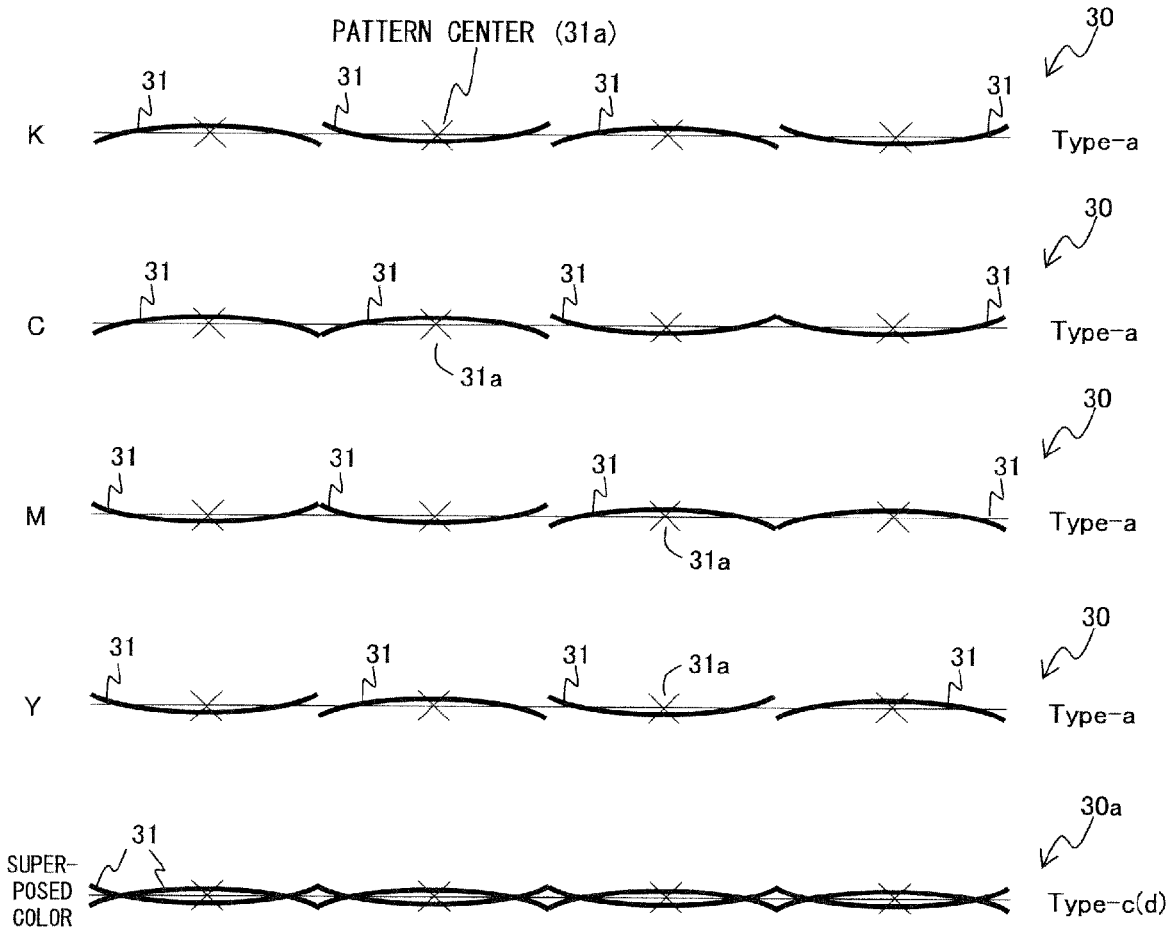
FIG. 14 is a schematic explaining one example of an operation when the first and the fourth adjustment conditions are combined in color recording in the recording apparatus, which is one preferred embodiment of the present invention.

At this time, if the above described adjustment of Type-a is made to short heads 12 within the head unit 11 for each color, and the adjustment of Type-d is made to the head units 11, the recording patterns 30 of the colors, and a superposed color pattern 30*a* become those shown in FIG. 14. In this case, also the pattern centers 31*a* of the unit patterns 31 recorded by the short heads 12 of the respective colors, which have the same recording region, match. Therefore, results similar to those acquired when the adjustment of Type-c is made to the short heads 12 of the respective colors are obtained.

It is proved from FIG. 14 that a shift among the short heads 12 of the respective colors is small, and a color shift is difficult to occur although level differences occur at some joints, in the recording pattern 30 of each color.

As described above, in the first preferred embodiment, also a shift from an input image can be reduced as a whole by suppressing also a color shift in the superposed color pattern 30*a* with the adjustment of Type-c (d) while suppressing a variations range in the sub-scanning direction FY with the adjustment of Type-a, although a level difference can possibly occur at a joint. As a result, a recording image the linearity and the color reproducibility of which are fine as the entire image can be obtained on the recording medium 40.

Figure 15:
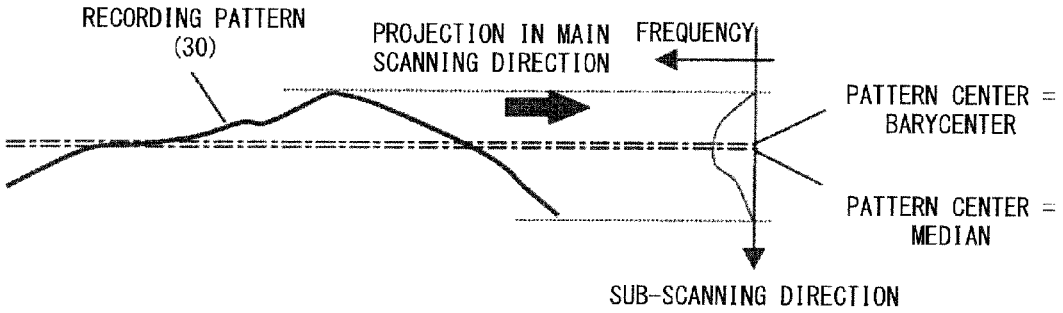
FIG. 15 is a conceptual schematic showing a modification example of the definition of a pattern center used in an adjustment condition in the recording apparatus, which is one preferred embodiment of the present invention.

Additionally, the description is provided by assuming the point, which is used as a reference when an adjustment is made, to be the pattern center 31.*a* of a unit pattern 31 here. However, since an adjustment according to a recording image is made with a timing adjustment in many cases, the barycenter or the median of projection of a recording pattern 30 in the main scanning direction FX, which is recorded by short heads 12, may be used as the center of a pattern as shown in FIG. 15. The position of a head or recording timing is adjusted so that the barycenter or the median falls within a predetermined range, whereby similar effect can be obtained.

Figure 16:
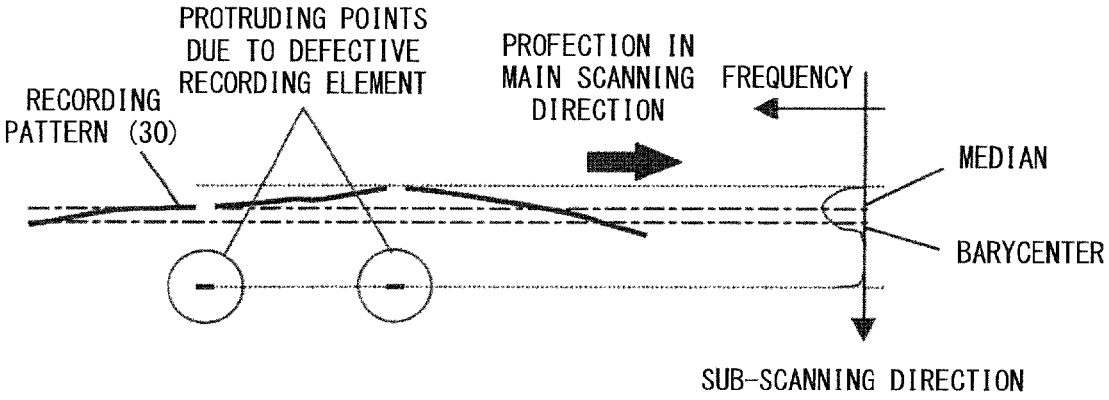
FIG. 16 is a conceptual schematic showing a modification example of the definition of a pattern center used in an adjustment condition in the recording apparatus, which is one preferred embodiment of the present invention.

Especially, if protruding points exist within the recording pattern 30 due to a defective recording element 12*a* as shown in FIG. 16, using the median removes this influence, and the quality of a recording image can be prevented from being degraded.

Second Preferred Embodiment

The second preferred embodiment is described by taking as an example a case where recording patterns 30 when a linear line image, which is parallel to the main scanning direction FX, is input to respective head units 11 are those shown in FIG. 13 in the recording apparatus having the recording mechanism unit 10 shown in FIG. 4.

Figure 17:
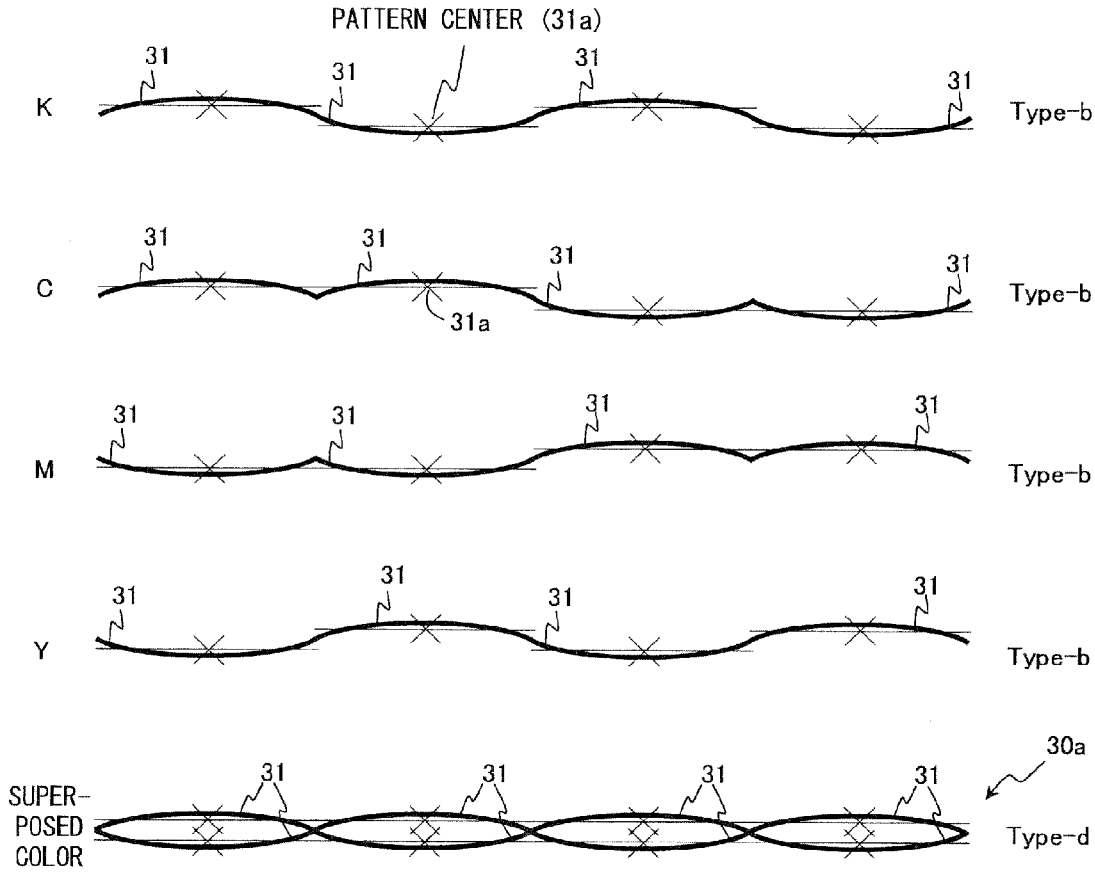
FIG. 17 is a schematic explaining one example of an operation when the second and the fourth adjustment conditions are combined in color recording in the recording apparatus, which is one preferred embodiment of the present invention.

At this time, if the above described adjustment of Type-b is made to the short heads 12 within the head unit 11 of each color, and the adjustment of Type-d is made to the head units 11, the recording patterns 30 of the respective colors, and a superposed color pattern 30*a* become those shown in FIG. 17.

It is proved from FIG. 17 that a shift among the short heads 12 of the respective colors becomes relatively large although no level differences at joints occur in the recording patterns of the colors. However, a color shift is reduced to a minimum when viewed in units of head units 11.

As described above, in the second preferred embodiment, level differences at joints do not exist, and a color shift as a head unit 11 can be suppressed by suppressing the color shift of the superposed color pattern 30*a* in the sub-scanning direction FY in units of head units 11 with the adjustment of Type-d while suppressing level differences at joints of the respective colors with the adjustment of Type-b, although a color shift in each short head 12 can occur. Therefore, the continuity of drawn lines of each color is fine, and a recording image the color reproducibility of which is not so poor can be obtained on the recording medium 40.

Third Preferred Embodiment

The third preferred embodiment is described by taking as an example a case where recording patterns 30 when a linear line image, which is parallel to the main scanning direction FX, is input to short heads 12 are those shown in FIG. 13 in the recording apparatus having the recording mechanism unit 10 shown in FIG. 4.

Figure 18:
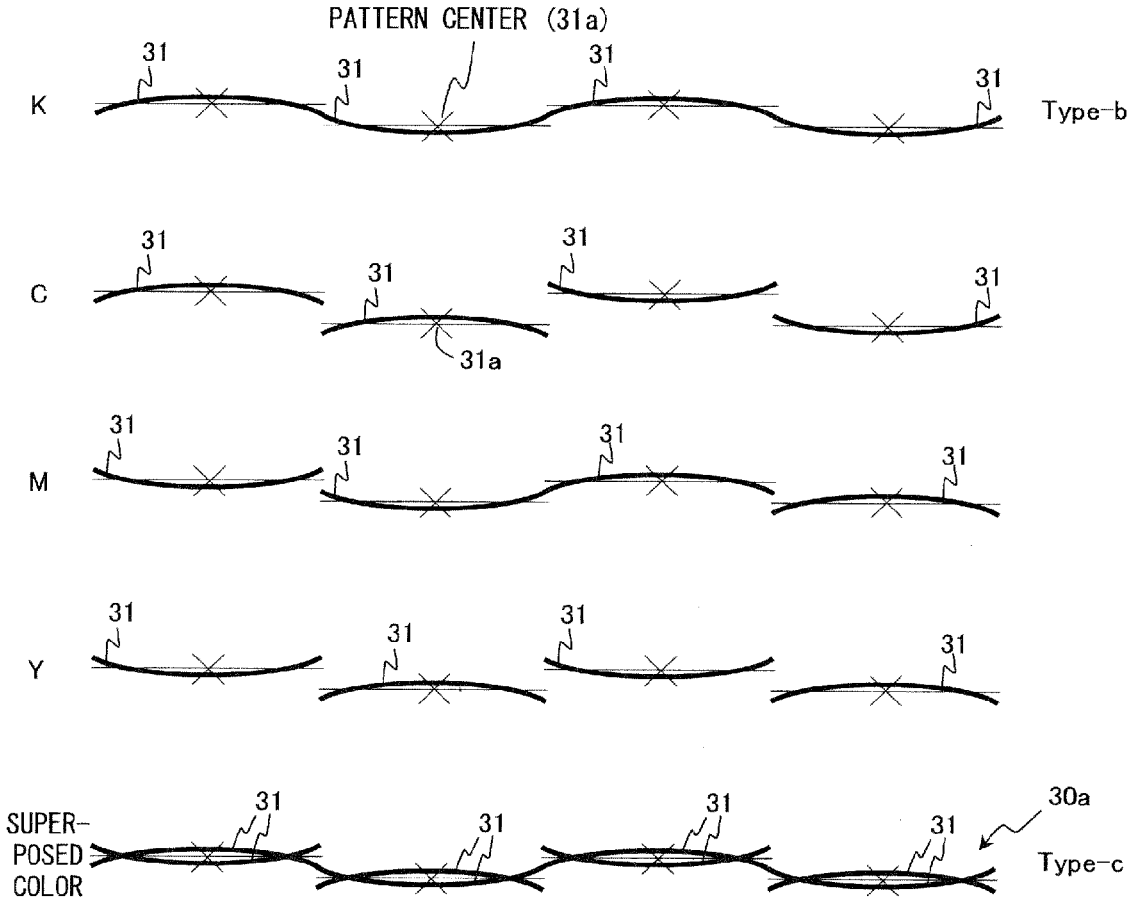
FIG. 18 is a schematic explaining one example of an operation when the second and the third adjustment conditions are combined in color recording in the recording apparatus, which is one preferred embodiment of the present invention.

At this time, if the adjustment of Type-b is made to the short heads 12 of K by using a color, which is utilized most frequently as a character or a drawn line within an image recorded by the recording apparatus, for example, black (K) as a reference color, and the adjustment of Type-c is made to the short heads 12 of the other colors with reference to K, the recording patterns 30 of the colors, and a superposed color pattern 30*a* become those shown in FIG. 18.

It is proved from FIG. 18 that no level differences at joints occur for the reference color K, a shift among the short heads 12 of the respective colors are small, and a color shift is difficult to occur.

As described above, in the third preferred embodiment, a color shift of the superposed color pattern 30*a* is suppressed with the adjustment of Type-c for other colors while suppressing level differences at joints with the adjustment of Type-b for a reference color, whereby a recording image where both the continuity of drawn lines of the reference color and the color reproducibility are fine can be obtained on the recording medium 40.

For the selection of a reference color, a color the shift of which is the most conspicuous and the density of which is high (a color the reflectance of which is low), or the like is desirable in addition to a color used frequently as a character or a drawn line. Thus, a level difference is suppressed in a color the level difference of which is easy to be conspicuous at a joint, and the quality of a recording image is difficult to be degraded as a whole.

Additionally, continuity at a joint is sufficient to be a level at which a level difference is not obtrusive, and a level difference does not always need to be 0. For example, a level difference of approximately one half of a recording pitch may be allowable. Especially, yellow (Y) has a high reflectance, and its level difference is inconspicuous. Therefore, the tolerance of level difference of Y may be a larger value.

As is known from FIG. 18, in the third preferred embodiment, a level difference of a reference color and a color shift among respective colors are preferentially adjusted. Therefore, level differences of the other colors are traded off. As described above, there are cases where a level difference of a reference color, level differences of other colors, and a color shift among respective colors are traded off. In such a case, a recording image of high quality can be obtained as a whole with adjustments made by reducing any of the level differences and the color shift to a predetermined tolerance value.

Figure 19:
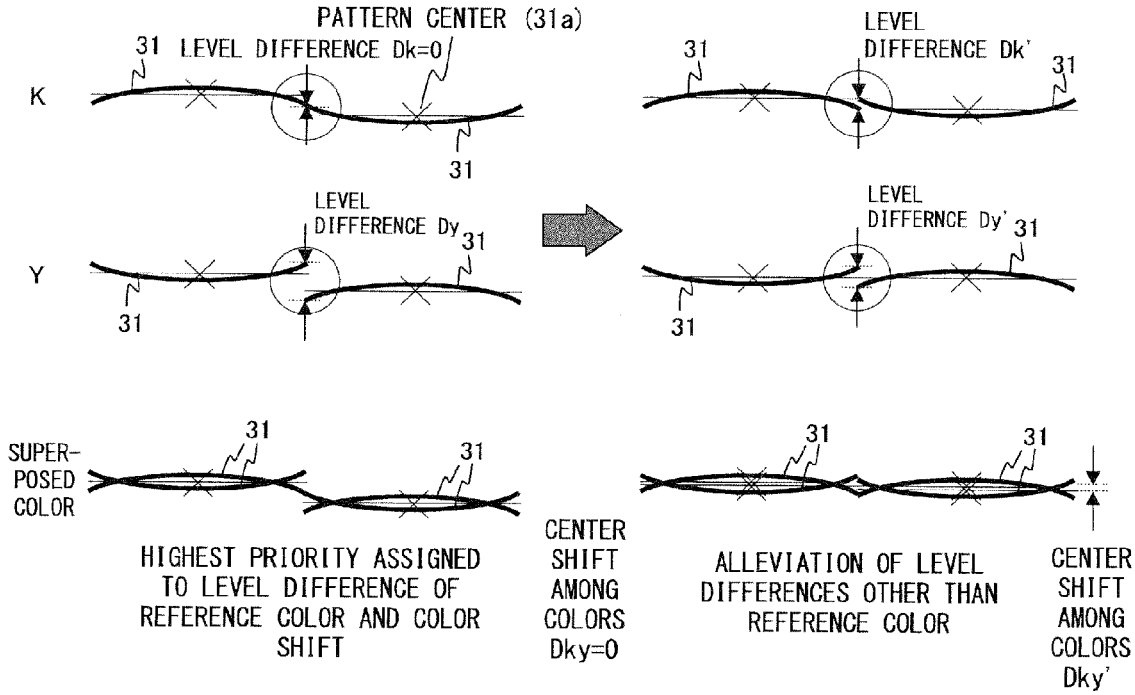
FIG. 19 is a schematic comparing and explaining the characteristics of various types of adjustment conditions in color recording in the recording apparatus, which is one preferred embodiment of the present invention.

FIG. 19 shows an example where the level difference of yellow (Y) is reduced from Dy (the left side of FIG. 19) to Dy' (the right side of FIG. 19) by tolerating the level difference of black (K) by a predetermined amount (level difference Dk'), and also by tolerating a pattern center shift among respective colors by a predetermined amount (Dky').

As is known from FIG. 19, the quality of a recording image can be improved by adjusting a level difference of a reference color, level differences of other colors, or a color shift among respective colors within the ranges of their tolerance values in order to alleviate the factor that degrades the quality of the recording image.

Additionally, in the third preferred embodiment, adjacent short heads 12 are arranged so that their recordable regions partially overlap. This is because recording, which is continuous in the main scanning direction FX, is enabled by selecting a suitable recording element 12*a* when a short head 12 that makes recording in an overlapping region 12*c* is switched, even if the alignment precision of the short head 12 in the main scanning direction FX is low. Also the effect of enabling a level difference which occurs at a joint to be suppressed is produced.

Figure 20:
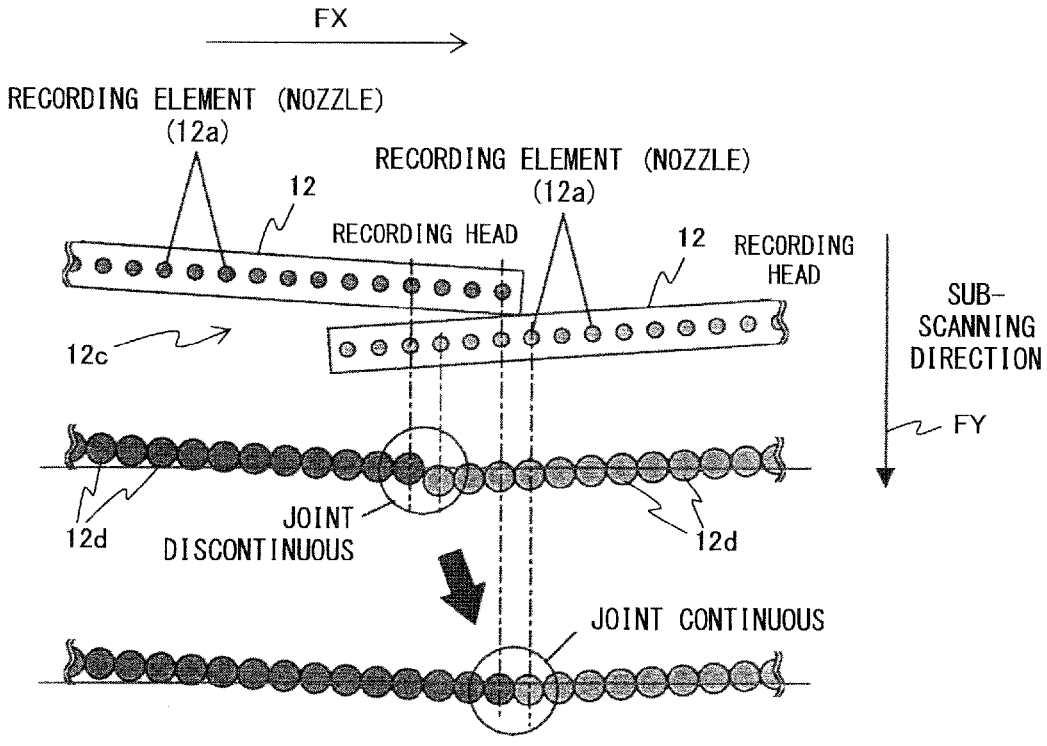
FIG. 20 is a schematic explaining an adjustment example of a joint of unit patterns in color recording in the recording apparatus, which is one preferred embodiment of the present invention.

For example, the level differences occur at the joints in the colors other than the reference color in FIG. 18. In this case, the level differences can be suppressed by selecting a recording element 12*a*, which switches data to place a joint not simply in the neighborhood of the center of an overlapping region 12*c* but in a position where a level difference is reduced to a minimum, as shown in FIG. 20.

Namely, for the selection of a recording element 12*a*, which serves as a joint in the overlapping regions 12*c*, it is desirable to consider not only continuity in the main scanning direction FX but also continuity in the sub-scanning direction FY.

In this way, a level difference at a joint can be further suppressed, and a recording image the continuity of which is fine can be obtained.

Fourth Preferred Embodiment

Exemplified above are the cases where settings are fixedly made by the adjustment value setting unit 25 of the recording controlling system 20 so that the adjustment (mode 1), which is suitable for a recording image the linearity and the color reproducibility of which are stressed as an entire image, is made in the above described first preferred embodiment, the adjustment (mode 2), which is suitable for a recording image also the color reproducibility of which is considered as a whole while stressing the continuity of drawn lines of each color, is made in the second preferred embodiment, and the adjustment (mode 3), which is suitable for a recording image where the continuity of drawn lines of a reference color and color reproducibility are stressed, is made in the third preferred embodiment.

In the meantime, the fourth preferred embodiment shows an example where a recording apparatus is configured to further comprise storing means for storing these three adjustment states (modes), which can be suitably switched according to the type of an image to be recorded.

Figure 21:
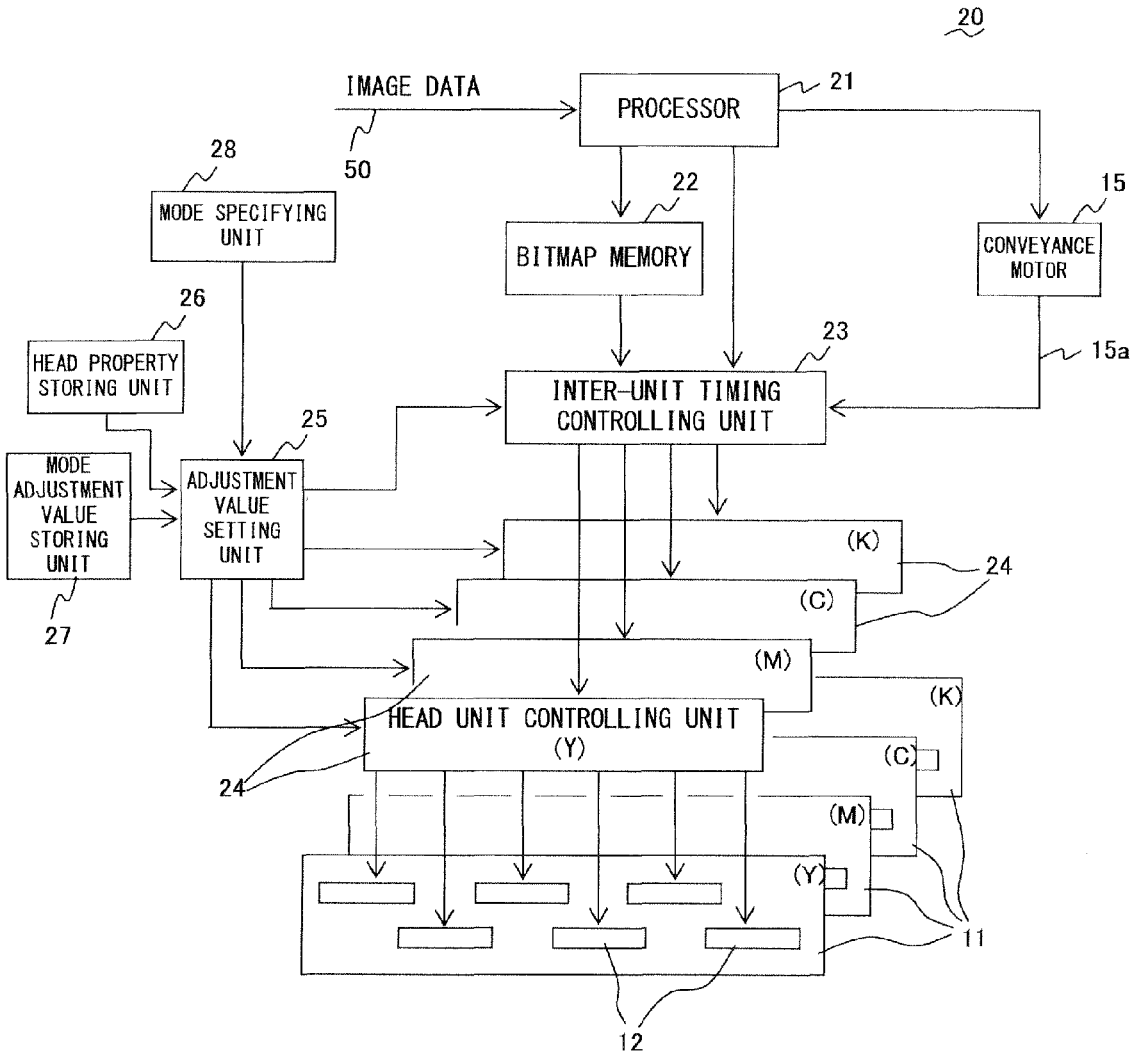
FIG. 21 is a block diagram showing a modification example of a recording controlling system in the recording apparatus, which is one preferred embodiment of the present invention.

Namely, in the fourth preferred embodiment, a mode specifying unit 28 for specifying the modes 1 to 3, and a mode adjustment value storing unit 27 for storing the adjustment value of each short head 12, which corresponds to each mode, are connected to an adjustment value setting unit 25 for setting an adjustment value according to a mode in a short head 12 as exemplified in FIG. 21. The rest of the apparatus is similar to the configuration exemplified in FIG. 3, and the same constituent elements are denoted with the same reference numerals.

Here, the mode specifying unit 28 specifies a mode according to a control panel, not shown, of the recording apparatus, or an external recording control signal, and the adjustment value setting unit 25 reads the adjustment value of each short head 12 from the mode adjustment value storing unit 27 according to specified mode, and sets the read value in the inter-unit timing controlling unit 23 and the head unit controlling unit 24. The inter-unit timing controlling unit 23 and the head unit controlling unit 24 adjust the position, the recording timing, etc. of the short head 12 based on the set adjustment value as described above.

In this way, an adjustment mode can be suitably selected by properly determining, depending on the property of an image to be recorded (image data 50), whether stress is placed on either the suppression of a level difference or that of a color shift, whereby a recording image of desired quality can be obtained.

Figure 22:
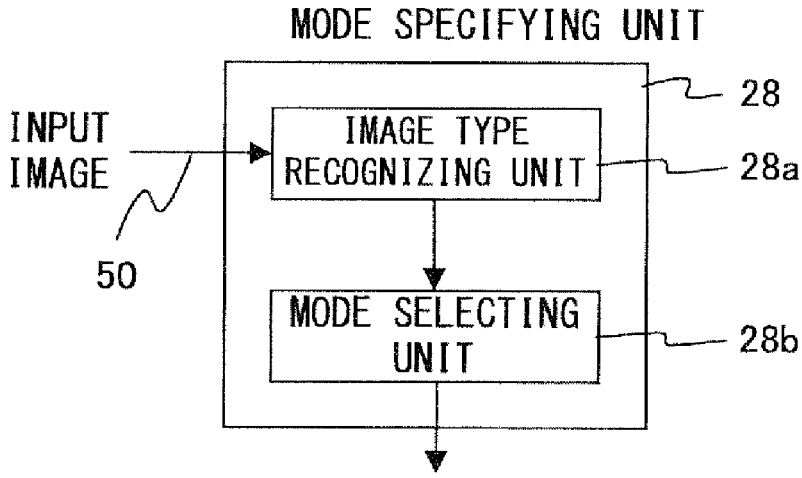
FIG. 22 is a block diagram showing a modification example of the recording controlling system in the recording apparatus, which is one preferred embodiment of the present invention.

Furthermore, if the mode specifying unit 28 is provided with an image type recognizing unit 28*a* for recognizing the type of an input image (image data 50), and a mode selecting unit 28*b* for automatically selecting a mode according to the type of an image as shown in FIG. 22, an input image can be recorded by setting an optimum mode according to the input image depending on need.

For example, if a text image is input, the mode 2, which places stress not on color reproducibility but on continuity at a boundary, is selected because the number of line components is large and the image is in a single color. As a result, the image is recorded in the mode 2. Additionally, a color to which higher priority must be assigned is determined according to the use frequency of each color within an image, and the above described reference color can be also set.

Figure 23:
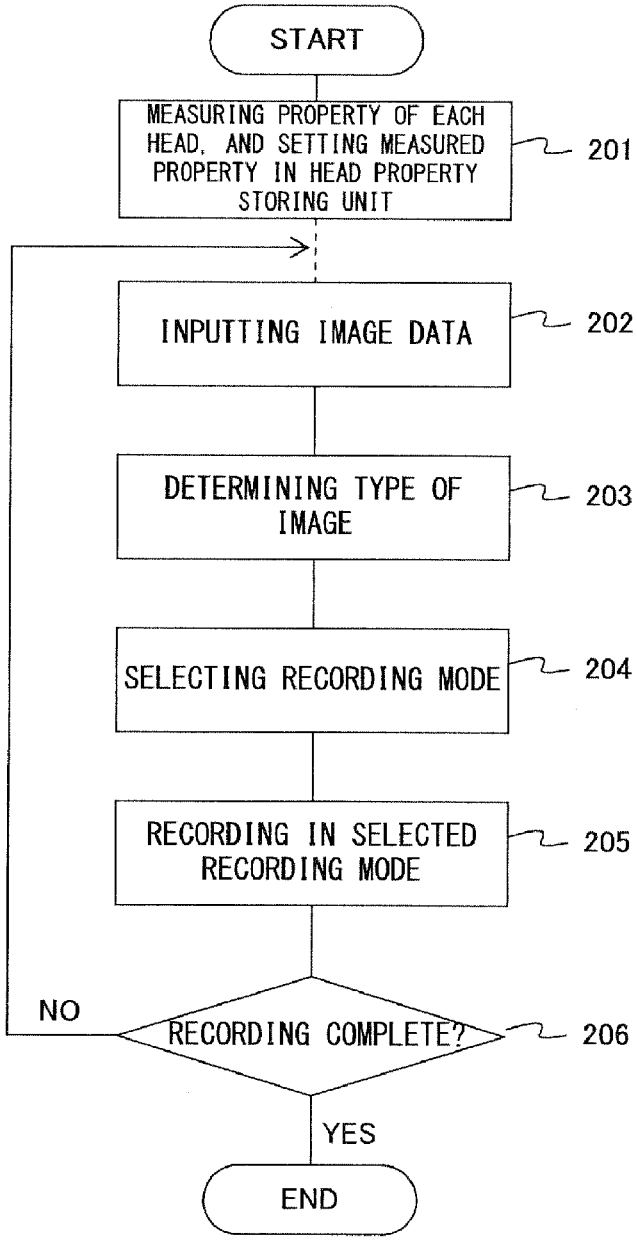
FIG. 23 is a flowchart showing one example of an operation in the recording apparatus according to a fourth preferred embodiment of the present invention.

FIG. 23 is a flowchart showing one example of the above described operation in the recording apparatus according to the fourth preferred embodiment.

Initially, in the manufacturing process of the recording apparatus, variations in the positions, etc. of recording elements 12*a* in each short head 12 in each head unit 11 are measured with a known examination technique, and stored in the head property storing unit 26 as referred to in the above described first preferred embodiment (step 201).

Thereafter, externally arrived image data 50 is input to both the processor 21 and the image type recognizing unit 28*a* of the mode specifying unit 28 (step 202). The image type recognizing unit 28*a* determines the type, such as a photo, a text, a drawn line, etc., of the image data 50 (step 203). The mode selecting unit 28*b* selects one of the above described modes 1 to 3 based on the result of the determination (step 204), and instructs the adjustment value setting unit 25. The adjustment value setting unit 25 specifies a combination of the above described Type-a to Type-d for the inter-unit timing controlling unit 23 and the head unit controlling unit 24 in order to implement the specified mode, so that the image data 50 is recorded on the recording medium 40 (step 205).

Then, the above described steps 202 to 205 are repeated until the recording of the image data 50 is complete (step 206).

In this way, image data can be recorded on the recording medium 40 in an optimum recording mode according to a property while determining the property of each piece of image data in the recording of the image data 50 where image data of different types such as a photo, a text, a drawn line, etc. coexist.

Figure 24:
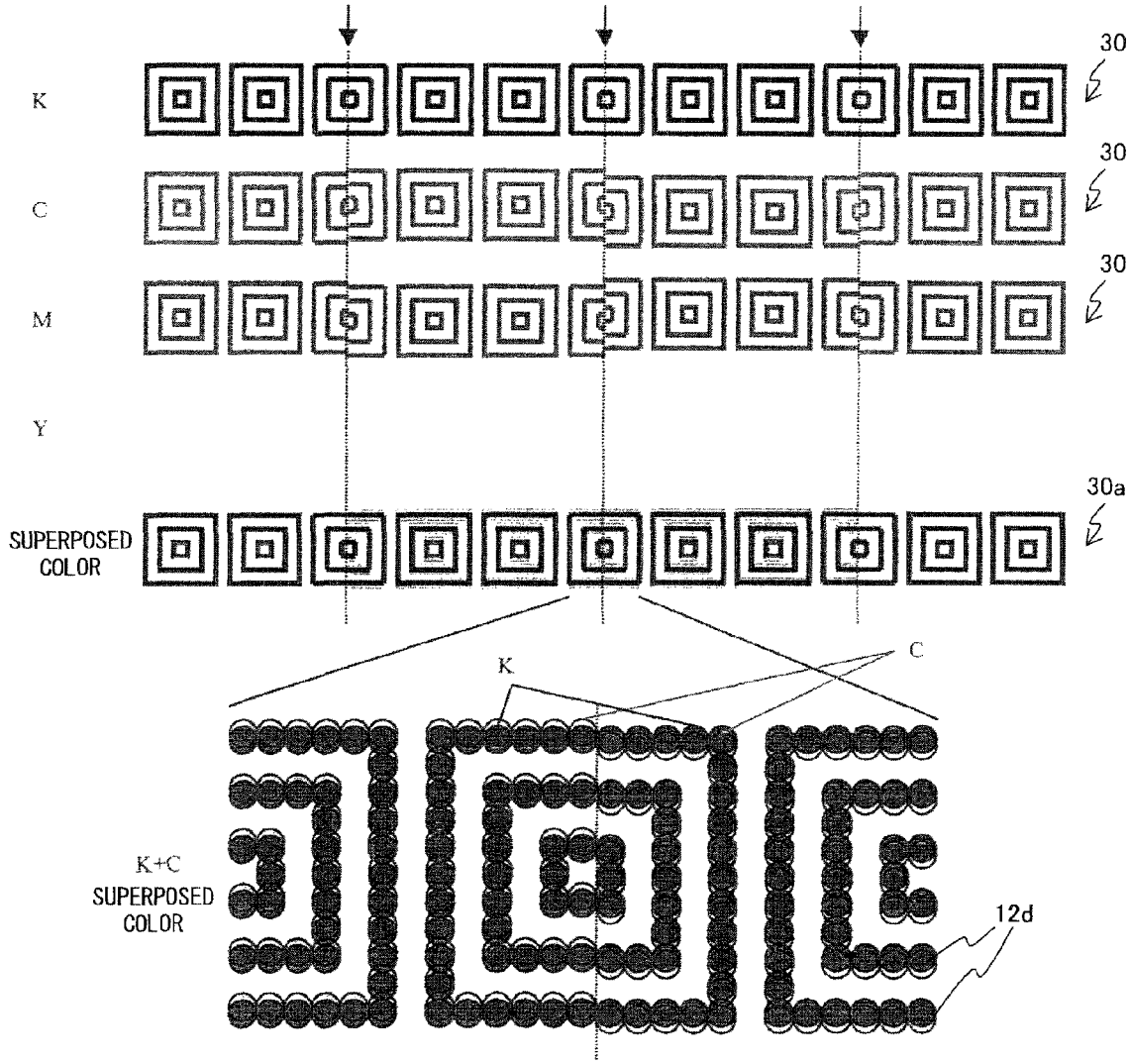
FIG. 24 is a conceptual schematic showing a modification example of a recording pattern recorded by the recording apparatus, which is one preferred embodiment of the present invention.

Up to this point, the first to the fourth preferred embodiments are described by using as a recording pattern a linear line image parallel to the main scanning direction. The reason why the linear line image is used is that the visual identification of a level difference at a joint or a color shift is fine, and also an explanation is easy. From the viewpoint of the fineness of visual identification, also a pattern obtained by combining lines as shown in FIG. 24 may be used.

In such a pattern, also a positional shift in the scanning direction can be detected simultaneously with a level difference at a joint or a color shift. Furthermore, if the position, the inclination or the timing of a head is made to actually match, a shift amount must be precisely measured in a geometrical manner. Therefore, it is desirable to measure the shift amount not with such a line or a pattern obtained by combining lines but with a dot pattern.

Note that the present invention is not limited to the configurations exemplified in the above described preferred embodiments, and various modifications can be made within a scope which does not deviate from the gist of the present invention as a matter of course.

For example, the above description is provided by taking as an example the case where the recording timing of each short head 12 is controlled as a method for controlling the pattern center 31*a* and the unit pattern center 31*b*. However, the control of the pattern center 31*a* and the unit pattern center 31*b* may be implemented by controlling the displacement, the inclination, etc. of a short head 12 itself in the sub-scanning direction FY.

INDUSTRIAL APPLICABILITY

According to the present invention, degradations in quality, such as discontinuity, a color shift, etc. can be adequately suppressed according to desired recording quality without being influenced by the distortion or the inclination shift of each short head, variations, etc. in the positions of recording elements due to manufacturing unevenness in a recording apparatus the pseudo line head of which is configured by combining short heads.

Additionally, according to the present invention, image recording can be implemented with diverse recording qualities on a recording medium without being influenced by the distortion or the inclination shift of each short head, variations, etc. in the positions of recording elements due to manufacturing unevenness in a recording apparatus the pseudo line head of which is configured by combining short heads.

The invention claimed is:

1. A recording apparatus comprising:

a conveyance mechanism for moving a recording medium in a first direction relative to recording heads;

a plurality of head units arranged in the first direction;

a plurality of recording heads, which are arranged in each of the plurality of head units and arranged in a second direction crossing the first direction so that recordable regions of the recording heads partially overlap or become continuous, for making desired image recording on the recording medium by combining a nearly line recording operation, which is performed by the plurality of recording heads in the second direction, and a moving operation of the recording medium, which is performed by the conveyance mechanism in the first direction;

first controlling means for controlling at least one of positions and inclinations of the plurality of recording heads in each of the plurality of head units, and one recording timing of each of the recording heads; and second controlling means for controlling at least one of positions and inclinations of the plurality of head units, and a recording timing of each of the head units;

wherein:

said first controlling means has a control function to implement at least one of a first adjustment condition under which a center of a predetermined recording pattern recorded by each of the plurality of recording heads within the head unit is placed almost in a same linear line in the second direction, and a second adjustment condition under which boundaries of the recording patterns recorded by the plurality of recording heads within the head unit become almost continuous; and said second controlling means has a control function to implement at least one of a third adjustment condition under which centers of the recording patterns recorded by the plurality of recording heads within the respective head units, which have a same recordable region, almost match in the second direction, and a fourth adjustment condition under which centers of the plurality of recording patterns, which are recorded by all the recording heads within the plurality of head units, for the respective head units, in the first direction almost match in the first direction.

2. The recording apparatus according to claim 1, wherein:

said first and said second controlling means control each of the recording heads and the head units so that the first and the third adjustment conditions are simultaneously satisfied.

3. The recording apparatus according to claim 1, wherein:

said first and said second controlling means control each of the recording heads and the head units so that the second and the fourth adjustment conditions are simultaneously satisfied.

4. The recording apparatus according to claim 1, wherein:

the plurality of recording heads are assigned to recording of a different color for each of the head units, a recording head of a predetermined color is adjusted to satisfy the second adjustment condition, and recording heads of other colors are adjusted to satisfy the third adjustment condition with reference to the predetermined color.

5. The recording apparatus according to claim 4, wherein:

the predetermined color comprises a color that is most frequently used as a character or a drawn line within an image recorded on the recording medium.

6. The recording apparatus according to claim 4, wherein:

the predetermined color comprises a color having a density which is highest among the respective colors.

7. The recording apparatus according to claim 1, wherein:

a recording boundary is set so that the second adjustment condition is satisfied in an overlapping region of adjacent recording heads.

8. The recording apparatus according to claim 1, wherein:

the center of the recording pattern is a barycenter of projection of the recording patterns recorded by the respective recording heads in the second direction.

9. The recording apparatus according to claim 1, wherein:

the center of the recording pattern is a median of projection of the recording patterns recorded by the respective recording heads in the second direction.

10. The recording apparatus according to claim 1, wherein:

the recording pattern comprises a line which is nearly orthogonal to the first direction.

11. The recording apparatus according to claim 1, further comprising:

mode storing means for storing at least some recording modes as adjustment modes, in which an adjustment is made so that the first to the fourth adjustment conditions and a combination of at least two of the first to the fourth adjustment conditions are satisfied; and mode switching means for switching among the recording modes according to a type of an image to be recorded on the recording medium.

* * * * *